US006289692B1

(12) United States Patent
Houser et al.

(10) Patent No.: US 6,289,692 B1
(45) Date of Patent: Sep. 18, 2001

(54) EFFICIENCY IMPROVEMENT OF OPEN-CYCLE CASCADED REFRIGERATION PROCESS FOR LNG PRODUCTION

(75) Inventors: Clarence G. Houser; Rong-Jwyn Lee; Ned Baudat, all of Sugar Land, TX (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/469,832

(22) Filed: Dec. 22, 1999

(51) Int. Cl.[7] ..... F25J 1/00
(52) U.S. Cl. ..... 62/613; 62/614
(58) Field of Search ..... 62/611, 613, 614

(56) References Cited

U.S. PATENT DOCUMENTS 3,616,652 * 11/1971 Engel ..... 62/613
5,363,655 * 11/1994 Kikkawa et al. ..... 62/613
5,537,827 * 7/1996 Low et al. ..... 62/613
5,611,216 3/1997 Low et al. ..... 62/612
5,722,255 3/1998 Brasz ..... 62/498
5,755,114 5/1998 Foglietta ..... 62/618

OTHER PUBLICATIONS

Swearingen, "Compare Methane Liquefying Processes", Hydrocarbo Processing, vol. 45, No. 8. Aug. 1966.*

* cited by examiner

*Primary Examiner*—William Doerrler
(74) *Attorney, Agent, or Firm*—Gary L. Haag

(57) ABSTRACT

This invention concerns a method and an apparatus for improving the efficiency of an open-cycle refrigeration process for LNG production by the employment of a liquid expander to recover energy associated with the flashing of a pressurized liquid stream and employing said recovered energy to compress the flashed vapor streams in the open cycle.

56 Claims, 2 Drawing Sheets

EFFICIENCY IMPROVEMENT OF OPEN-CYCLE CASCADED REFRIGERATION PROCESS FOR LNG PRODUCTION

This invention concerns a method and an apparatus for improving the efficiency of an open-cycle refrigeration process for LNG production by the employment of a liquid expander to recover energy associated with the flashing of a pressurized liquid stream and employing said recovered energy to compress at least one flashed vapor stream in the open cycle.

BACKGROUND

It is common practice to cryogenically treat natural gas to liquefy the same for transport and storage. The primary reason for the liquefaction of natural gas is that liquefaction results in a volume reduction of about 1/600, thereby making it possible to store and transport the liquefied gas in containers of more economical and practical design. For example, when gas is transported by pipeline from the source of supply to a distant market, it is desirable to operate the pipeline under a substantially constant and high load factor. Often the deliverability or capacity of the pipeline will exceed demand while at other times the demand may exceed the deliverability of the pipeline. In order to shave off the peaks where demand exceeds supply, it is desirable to store the excess gas in such a manner that it can be delivered when the supply exceeds demand, thereby enabling future peaks in demand to be met with material from storage. One practical means for doing this is to convert the gas to a liquefied state for storage and to then vaporize the liquid as demand requires.

Liquefaction of natural gas is of even greater importance in making possible the transport of gas from a supply source to market when the source and market are separated by great distances and a pipeline is not available or is not practical. This is particularly true where transport must be made by ocean-going vessels. Ship transportation in the gaseous state is generally not practical because appreciable pressurization is required to significantly reduce the specific volume of the gas which in turn requires the use of more expensive storage containers.

In order to store and transport natural gas in the liquid state, the natural gas is preferably cooled to −240° F. to −260° F. where it possesses a near-atmospheric vapor pressure. Numerous systems exist in the prior art for the liquefaction of natural gas or the like in which the gas is liquefied by sequentially passing the gas at an elevated pressure through a plurality of cooling stages whereupon the gas is cooled to successively lower temperatures until the liquefaction temperature is reached. Cooling is generally accomplished by heat exchange with one or more refrigerants such as propane, propylene, ethane, ethylene, methane and mixtures thereof. In the art, the refrigerants are frequently arranged in a cascaded manner and each refrigerant is employed in a closed refrigeration cycle. When the condensed liquid is at an elevated pressure, further cooling is possible by flashing the liquefied natural gas to atmospheric pressure in one or more expansion stages. The flashing is generally accomplished via the use of expansion valves. In each stage, the liquefied gas is flashed to a lower pressure thereby producing a two-phase gas-liquid mixture at a significantly lower temperature. The liquid is recovered and may again be flashed. In this manner, the liquefied gas is further cooled to a storage or transport temperature suitable for liquefied gas storage at near-atmospheric pressure. In this expansion to near-atmospheric pressure, significant volumes of flash vapors are produced. The flash vapors from the expansion stages are generally collected and recycled for liquefaction or utilized as fuel gas for power generation.

In an open cycle cascaded refrigeration process, the cycle comprises the steps of flashing a pressurized LNG-bearing stream in discrete steps, warming the resulting flash vapor streams by employing such streams as refrigeration streams, recompressing a substantial portion of the resulting warmed flash vapor streams, cooling said compressed gas stream and returning the compressed cooled gas stream to the liquefaction process for liquefaction. As previously noted, the flashing of a pressurized LNG-bearing stream to near-atmospheric pressure is generally performed with expansion valves. From a thermodynamic perspective, such flashing is a highly irreversible process.

SUMMARY OF THE INVENTION

It is an object of this invention to increase the efficiency of an open-cycle cascaded refrigeration process for LNG production.

It is a further object of this invention to increase the efficiency of an open-cycle cascaded refrigeration process for LNG production by recovering energy associated with the flashing of a pressurized LNG-bearing stream to near atmospheric pressure.

It is a still further object of the present invention to increase the efficiency of an open-cycle cascaded refrigeration process for LNG production by recovering energy associated with the flashing of a pressurized LNG-bearing stream and employing said energy in the liquefaction process.

It is still yet a further object of this invention to increase the efficiency in of an open-cycle cascaded refrigeration process for LNG production by recovering energy associated with the flashing of a pressurized LNG-bearing stream and employing said energy in the open-cycle of said liquefaction process.

It is yet a further object of the invention to increase the efficiency of an open-cycle cascaded refrigeration process for LNG production by recovering mechanical energy from the flashing of a pressurized LNG-bearing stream and directly employing said mechanical energy to compress flash vapors or gases in the open-cycle of said liquefaction process.

In one embodiment of this invention wherein an open-cycle cascaded refrigeration process for LNG production produces a LNG-bearing stream at an elevated pressure and said stream is flashed in an open methane refrigeration cycle via multiple stages of pressure reduction to a near-atmospheric pressure, an improvement has been discovered comprising in at least one of said pressure reduction stages:

(a) flashing a pressurized LNG-bearing stream in an expander thereby generating a two-phase stream and energy;

(b) separating said two-phase stream into a gas stream and lower pressure predominantly LNG-bearing stream;

(c) compressing said gas stream in a compressor thereby producing a pressurized gas stream and wherein said compressor is powered at least in part by the energy of step (a); and (d) returning said pressurized gas stream to the multi-stage compressor employed in the open methane refrigeration cycle.

In another embodiment of this invention, an apparatus for conducting the preceding process has been discovered.

DESCRIPTION OF THE PREFERRED EMBODIMENTS

Figure 1:
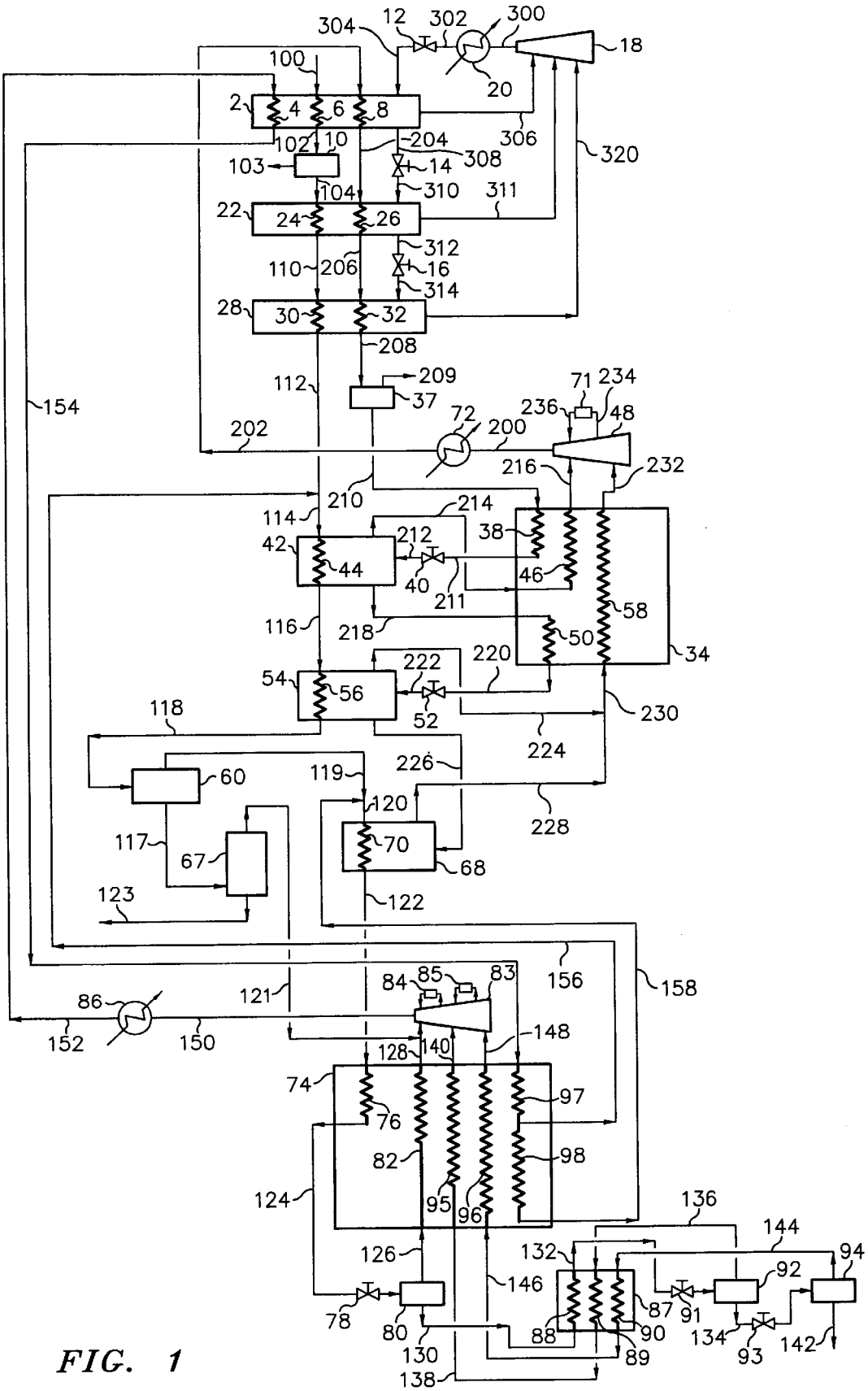
FIG. 1 is a simplified flow diagram of a LNG production process which illustrates the methodology and apparatus of an open-cycle cascaded refrigeration process for LNG production.

As used herein, the term open-cycle cascaded refrigeration process refers to a cascaded refrigeration process employing at least one closed refrigeration cycle and one open cycle wherein the boiling point of the refrigerant/cooling agent in the open cycle is less than the boiling point of the refrigerating agent or agents employed in the closed cycle or cycles and a portion of the cooling duty to condense the compressed open-cycle refrigerant/cooling agent is provided by one or more of the closed cycles.

In a preferred embodiment, the invention concerns the cooling of a natural gas stream at an elevated pressure, for example about 650 psia, by sequentially cooling the gas stream by passage through a multistage propane cycle, a multistage ethane or ethylene cycle and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point.

Pretreatment of Natural Gas Feed Streams

Pretreatment steps provide a means for removing undesirable components such as acid gases, mercaptan, mercury and moisture from the natural gas stream delivered to the facility. The composition of this gas stream may vary significantly. As used herein, a natural gas stream is any stream principally comprised of methane which originates in major portion from a natural gas feed stream, such feed stream for example containing at least 85% by volume, with the balance being ethane, higher hydrocarbons, nitrogen, carbon dioxide and a minor amounts of other contaminants such as mercury, hydrogen sulfide, and mercaptan.

The pretreatment steps may be separate steps located either upstream of the cooling cycles or located downstream of one of the early stages of cooling in the initial cycle. The following is a non-inclusive listing of some of the available means which are readily available to one skilled in the art. Acid gases and, to a lesser extent, mercaptans are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves. Processes employing sorbent beds are generally located downstream of the first cooling stage in the initial cooling cycle.

Liquefaction via an Open-Cycle Cascaded Refrigeration Process

The natural gas stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 650 psia. The stream temperature is typically near ambient to slightly above ambient. A representative temperature range being 60 F. to 120 F.

As previously noted, the natural gas stream is cooled in a plurality of multistage (for example, three) cycles or steps by indirect heat exchange with a plurality of refrigerants, preferably three. The overall cooling efficiency for a given cycle improves as the number of stages increases but this increase in efficiency is accompanied by corresponding increases in net capital cost and process complexity. The natural gas stream is preferably passed through an effective number of refrigeration stages, nominally 2, preferably two to four, and more preferably three stages, in the first closed refrigeration cycle utilizing a relatively high boiling refrigerant. Such refrigerant is preferably comprised in major portion of propane, propylene or mixtures thereof, more preferably propane, and most preferably the refrigerant consists essentially of propane. Thereafter, the stream flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof more preferably ethylene, and most preferably the refrigerant consists essentially of ethylene. Each cooling stage comprises a separate cooling zone.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas stream in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, the capital and operating costs of gas/liquid separations at candidate locations, and other factors routinely considered by those skilled in the art of LNG plant and gas plant operation. The $C_2$+ hydrocarbon stream or streams may be demethanized via a single stage flash or a fractionation column. In the latter case, the methane-rich stream can be directly returned at pressure to the liquefaction process. In the former case, the methane-rich stream can be repressurized and recycle or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (ex., $C_2$, $C_3$, $C_4$ and $C_5$+). In the last stage of the second cooling cycle, the gas stream which is predominantly methane is condensed (i.e., liquefied) in major portion, preferably in its entirety, thereby producing a LNG-bearing stream at elevated pressure. The process pressure at this location is only slightly lower than the pressure of the feed gas to the first stage of the first cycle.

The pressurized LNG-bearing stream is then further cooled in an open methane refrigeration cycle. In this third cooling step, the pressurized LNG-bearing stream is cooled via contact in a main methane economizer with flash gas stream generated in this third step in a manner to be described later and subsequent expansion of the liquefied gas stream to near atmospheric pressure. During this expansion, the pressurized LNG-bearing stream is cooled via at least one, preferably two to four, and more preferably three expansions where each expansion employs as a pressure reduction means either expansion valves or liquid expanders. The inventive aspect of the invention claimed herein resides in the manner in which energy generated by one or more liquid expanders is employed directly in the open methane refrigeration cycle. Each expansion of the pressurized LNG-bearing stream is followed by a separation of the gas-liquid product with a separator. In one variation, additional cooling of this stream prior to flashing is made possible by first flashing in its entirety a portion of the stream via one or more expansion steps and then via indirect heat exchange means employing said flashed stream or streams to cool the pressurized LNG-bearing stream prior to flashing. The flashed product is then recycled via return to an appropriate location, based on temperature and pressure considerations, in the open methane cycle and recompressed.

As used herein, open methane cycle stream will refer to any stream which is predominantly methane and originates in major portion from flash vapors from a pressurized LNG-bearing stream or streams, as the case may be. Open methane cycle will refer to an open refrigeration cycle employing said stream. Liquefied product will generically be referred to as methane although it may contain minor concentrations of other constituents.

When the LNG-bearing stream entering the third cycle is at a preferred pressure of about 600 psia, representative expansion pressures for a three stage expansion process are about 190, 61 and 24.7 psia. Vapors generated in the nitrogen separation step to be described and/or generated via expansion are utilized in the main methane economizer to cool the just liquefied product from the second cycle/step prior to expansion and to cool the compressed open methane cycle stream. The inventive process and associated apparatus for recovering energy from the expansion steps and employing said energy in the open methane cycle will be discussed in a later section. Expansion of the pressurized LNG-bearing stream to near atmospheric pressure produces an LNG product possessing a temperature of −240° F. to −260° F.

Nitrogen Removal from Natural Gas Streams

To maintain an acceptable BTU content in the liquefied product when appreciable nitrogen exists in the natural gas feed stream, nitrogen must be concentrated and removed at some location in the process. Various techniques are available for this purpose to those skilled in the art. The following are examples. When nitrogen concentration in the natural gas feed stream is low, typically less than about 1.0 vol. %, nitrogen removal is generally achieved by removing a small stream at the high pressure inlet or outlet port at the open methane cycle compressor. When the nitrogen concentration in the natural gas feed stream is about 1.0 to about 1.5 vol %, nitrogen can be removed by subjecting the LNG-bearing stream from the main methane economizer to an expansion prior to the expansion steps previously discussed. This expansion vapor will contain an appreciable concentration of nitrogen and may be subsequently employed as a fuel gas. A typical expansion pressure for nitrogen removal at these concentrations is about 400 psia. When the natural gas feed stream contains a nitrogen concentration of greater than about 1.5 vol %, the expansion step following flow through the main methane economizer may not provide sufficient nitrogen removal and a nitrogen rejection column will be required from which is produced a nitrogen rich vapor stream and a liquid stream. In a preferred methodology employing a nitrogen rejection column, the LNG-bearing stream to the main methane economizer is split into a first and second portion. The first portion is expanded to approximately 400 psia and the two-phase mixture is fed as a feed stream to the nitrogen rejection column. The second portion of the LNG-bearing stream is further cooled by flowing through the main methane economizer. This stream is then expanded to 400 psia, and the resulting two-phase mixture is fed to the column where it provides reflux. The nitrogen-rich gas stream produced from the top of the nitrogen rejection column will generally be used as fuel. Produced from the bottom of the column is a liquid stream which is either returned to the main methane economizer for cooling or preferably, is fed to the next stage of expansion in the open methane cycle.

Refrigerative Cooling

Critical to the liquefaction of natural gas in a cascaded process is the use of one or more refrigerants for transferring thermal energy from the natural gas stream to the refrigerant and ultimately to the environment. In essence, the overall refrigeration system functions as a heat pump by removing thermal energy from the natural gas stream as the stream is progressively cooled to lower temperatures and rejecting the majority of such thermal energy to the environment.

The liquefaction process uses several types of cooling which include but are not limited to (a) indirect heat exchange, (b) vaporization and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, in the cascaded refrigeration process, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger (ex., aluminum and aluminum alloys are preferred materials of construction for the core in core-in-kettle heat exchanges but such materials may not be compatible with the process conditions of interest). A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means may be an expansion valve (frequently referred to as a Joule-Thomson expansion valve or J-T valve), a liquid or hydraulic expander, or a gas expander. As used herein, liquid expanders and hydraulic expanders will be used interchangeably and refer to an expander which processes a predominantly liquid stream. Because expanders recover work energy from the expansion process, process stream temperatures for expansion to a given pressure are lower than when using an expansion valve. A key aspect of the current invention is the manner in which energy recovered via the expansion of a pressurized LNG-bearing stream is subsequently employed in the open methane cycle and the ramifications of such employment on the operational efficiency of the overall liquifaction process.

In the discussion and drawings to follow, the discussions or drawings may depict the expansion of a refrigerant by flowing through a throttle valve followed by a subsequent separation of gas and liquid portions in the refrigerant chillers wherein indirect heat-exchange also occurs. While this simplified scheme is workable and sometimes preferred because of cost and simplicity, it may be more effective to carry out expansion and separation and then partial evaporation as separate steps, for example a combination of throttle valves and flash drums prior to indirect heat exchange in the chillers. In another workable embodiment, the throttle or expansion valve may not be a separate item but an integral part of the refrigerant chiller (i.e., the flash occurs upon entry of the liquefied refrigerant into the chiller).

First Cooling Cycle

In the first cooling cycle or step, cooling is provided by the compression of a higher boiling point gaseous refrigerant, preferably propane, to a pressure where it can be liquefied by indirect heat transfer with a heat transfer medium which ultimately employs the environment as a heat sink, that heat sink generally being the atmosphere, a fresh water source, a salt water source, the earth or a two or more of the preceding. The condensed refrigerant then undergoes one or more steps of expansion cooling via suitable expansion means thereby producing two-phase mixtures possessing significantly lower temperatures. In one embodiment, the main refrigerant stream is split into at least two separate streams, preferably two to four streams, and most preferably three streams where each stream is separately expanded to a designated pressure. Each stream then provides vaporative cooling via indirect heat transfer with one or more selected streams, one such stream being the natural gas stream to be liquefied. The number of separate refrigerant streams will correspond to the number of refrigerant compressor stages. The vaporized refrigerant from each respective stream is then returned to the appropriate stage at the refrigerant compressor (e.g., two separate streams will correspond to a two-stage compressor). In a more preferred embodiment, all liquefied refrigerant is expanded to a predesignated pressure and this stream then employed to provide vaporative cooling via indirect heat transfer with one or more selected streams, one such stream being the natural gas stream to be liquefied. A portion of the liquefied refrigerant is then removed from the indirect heat exchange means, expansion cooled by expanding to a lower pressure and correspondingly lower temperature where it provides vaporative cooling via indirect heat exchange means with one or more designated streams, one such stream being the natural gas stream to be liquefied. Nominally, this embodiment will employ two such expansion cooling/vaporative cooling steps, preferably two to four, and most preferably three. Like the first embodiment, the refrigerant vapor from each step is returned to the appropriate inlet port at the staged compressor.

Second Cooling Cycle

In a cascaded refrigeration system, a significant portion of the cooling for liquefaction of the lower boiling point refrigerants streams (i.e., the refrigerants employed in the second and third cycles) is made possible by cooling these streams via indirect heat exchange with selected higher boiling refrigerant streams. This manner of cooling is referred to as "cascaded cooling." In effect, the higher boiling refrigerant streams function as heat sinks for the lower boiling refrigerant streams or stated differently, heat energy is pumped from the natural gas stream to be liquefied to a lower boiling refrigerant stream and is then pumped (i.e., transferred) to one or more higher boiling refrigerant streams prior to transfer to the environment via an environmental heat sink (ex., fresh water, salt water, atmosphere). As in the first cycle, refrigerant employed in the second and third cycles is compressed via compressors, preferably multi-staged compressors, to preselected pressures. When possible and economically feasible, the compressed refrigerant vapor stream is first cooled via indirect heat exchange with one or more cooling agents (ex., air, salt water, fresh water) directly coupled to environmental heat sinks. This cooling may be via inter-stage cooling between compression stages or cooling of the fully compressed refrigerant stream. The compressed stream is then further cooled via indirect heat exchange with one or more of the previously discussed cooling stages for the higher boiling point refrigerants. As used herein, compressor shall refer to compression equipment associated with all stages of compression and any equipment associated with inter-stage cooling.

The second cycle refrigerant, preferably ethylene, is preferably first cooled after compression via indirect heat exchange with one or more cooling agents directly coupled to an environmental heat sink (i.e., inter-stage and/or post-cooling following compression) and then further cooled and finally liquefied via sequentially contacted with the first and second or first, second and third cooling stages for the highest boiling point refrigerant which is employed in the first cycle. The preferred second and first cycle refrigerants are ethylene and propane, respectively.

Open Methane Cycle

In the open-cycle portion of the cascaded refrigeration system such as illustrated in FIG. 1, cooling occurs by (1) subcooling the LNG-bearing streams prior to expanding by contacting said streams with downstream expansion vapors and (2) cooling a compressed recycle stream by contacting with said expansion vapors. As just noted, the LNG-bearing stream from the second cycle is first cooled in the open or third cycle via indirect contact with one or more expansion vapor streams from subsequent expansion steps followed by the subsequent pressure reduction of the cooled stream. The pressure reduction is conducted in one or more discrete steps. In each step, significant quantities of methane-rich vapor at a given pressure are produced. Each vapor stream preferably undergoes significant heat transfer in the methane economizers via contact with a pressurized LNG-bearing stream about to be expanded and/or the compressed recycle stream and is preferably returned to the inlet port of a compressor stage on the open-cycle compressor at near-ambient temperatures. In the course of flowing through the methane economizers, the expansion vapor streams are contacted with warmer streams in a generally countercurrent manner, preferably a countercurrent manner, and in a sequence designed to maximize the cooling of the warmer streams. The pressure selected for each stage of expansion cooling is such that for each stage, the volume of gas generated plus the compressed volume of vapor from the adjacent lower stage results in efficient overall operation of the multi-staged compressor.

The warmed expansion vapor streams (i.e. warmed recycle streams) excluding any nitrogen rejection stream, are returned, preferably at near-ambient temperature, to the inlet ports of the open-cycle compressor whereupon these streams are compressed to a pressure such that they can be combined with the main process stream prior to liquefaction. Interstage cooling and cooling of the compressed recycle gas stream is preferred and preferably accomplished via indirect heat exchange with one or more cooling agents directly coupled to an environment heat sink. The compressed recycle stream is then further cooled via indirect heat exchange with refrigerant in the first and second cycles, preferably the first cycle refrigerant in all stages, more preferably the first two stages and most preferably, the first stage and further cooled via indirect heat exchange with flash vapor streams in the main methane economizer. The cooled compressed recycle stream is then combined with the main process stream prior to the final stage of cooling in the second cycle wherein the combined stream is liquefied. Preferably, the compressed recycle stream after cooling in the first and/or second cycles is selectively cooled in such a manner that two or more return streams of different temperatures are produced and these streams are subsequently combined with the main process stream in the cascaded refrigeration process at locations where the respective stream temperatures are similar. The partitioning of this stream (i.e. cooled compressed recycle stream) into two to four return streams is preferred and two to three return streams are more preferred. Most preferred is partitioning or splitting of the cited stream into two return streams because of the increase in efficiency at minimal increase in capital cost and process complexity. For four return streams, each stream is preferably comprised of 10 to 70% of the compressed recycle stream, more preferably 15 to 55%, and most preferably about 25%. For three return streams, each stream is preferably comprised of 10 to 80% of the compressed recycle stream, more preferably 20 to 60%, and most preferably about 33%. For two return streams, each stream is preferably comprised of 20 to 80% of the recycle stream, more preferably 25 to 75%, and most preferably about 50%. When the closed refrigeration cycle immediately upstream of the open cycle consists of two or three stages, the most preferred configuration is two return streams with return locations upstream of the first stage chiller and upstream of the last stage condenser wherein the combined process stream, that being the main process stream and all recycle streams, is liquefied in major portion.

optimization via Inter-stage and Inter-cycle Heat Transfer

Returning the refrigerant gas streams to their respective compressors at or near ambient temperature is generally favored. Not only does this step improve overall efficiencies, but difficulties associated with the exposure of compressor components to cryogenic conditions are greatly reduced. This is accomplished via the use of economizers wherein streams comprised in major portion of liquid and prior to flashing are first cooled by indirect heat exchange with one or more vapor streams generated in a downstream expansion step (i.e., stage) or steps in the same or a downstream cycle. As an example, expansion vapors in the open or third cycle preferably flow through one or more economizers where (1) these vapors cool via indirect heat exchange the pressurized LNG-bearing streams prior to each pressure reduction stage and (2) these vapors cool via indirect heat exchange the compressed recycle stream prior to combination with the main process stream. These cooling steps will be discussed in greater detail in the discussion of FIG. 1. In one embodiment wherein ethylene and methane are employed in the second and open or third cycles respectively, the contacting can be performed via a series of ethylene and methane economizers. In the preferred embodiment which is illustrated in FIG. 1 and which will be discuss in greater detail later, there is a main ethylene economizer, a main methane economizer and one or more additional methane economizers. These additional economizers are referred to herein as the second methane economizer, the third methane economizer and so forth and each additional methane economizer corresponds to a separate downstream flash step.

Physically, the cited economizers can be single units or combined into one or more larger units which contain the required indirect heat exchange means arranged in such a matter as to provide indirect contact between the streams set forth herein.

Inventive Open Methane Cycle

In the current invention, an LNG-bearing stream at elevated pressure is flashed in an open methane refrigeration cycle via multiple stages of pressure reduction to a near-atmospheric pressure by performing in at least one of said pressure reduction stages the steps of (a) flashing a pressurized LNG-bearing stream in an expander thereby generating a two-phase stream and energy; (b) separating said two-phase stream into a gas stream and lower pressure LNG-bearing stream; (c) compressing said gas stream in a compressor thereby producing a pressurized gas stream and wherein said compressor is powered at least in part by the energy of step (a); and (d) returning said pressurized gas stream to the multi-stage compressor employed in the open methane refrigeration cycle. In a preferred embodiment, the energy of step (a) is the sole source of energy for the compression step of step (c). In another preferred embodiment, steps (a)–(d) are employed in at least the first pressure reduction stage.

In a more preferred embodiment, the LNG-bearing stream produced at an elevated pressure is flashed to near-atmospheric pressure by three pressure reduction stages and steps (a)–(d) are employed in the first and second pressure reduction stages. In a still more preferred embodiment, each pressurized LNG-bearing stream is contacted via an indirect heat exchange means prior to step (a) with the gas stream of step (b) prior to step (c) thereby cooling said pressurized LNG-bearing stream and warming said gas stream.

In a yet more preferred embodiment, the LNG-bearing stream produced at elevated pressure is flashed to near-atmospheric pressure by three pressure reduction stages, steps (a)–(d) are employed in the first and second pressure reduction stages and prior to the initial flash of pressurized LNG-bearing stream said stream is contacted via an indirect heat exchange means with the gas stream of step (b) prior to step (c) thereby cooling the pressurized LNG-bearing stream and warming the gas stream. In a preferred embodiment of the preceding embodiment, the pressurized LNG-bearing stream to the second pressure reduction stage is contacted via an indirect heat exchange means with the gas stream of step (b) of said stage prior to step (c) of said stage thereby cooling the pressurized LNG-bearing stream and warming the gas stream. In yet a more preferred embodiment of the preceding, said warmed gas stream of the second pressure reduction stage is contacted via indirect heat exchange means with the LNG-bearing stream of the first pressure reduction stage thereby further warming said gas stream prior to return to the open-cycle methane compressor.

In the preceding embodiments, it is preferred that the pressure of each of the pressurized gas streams of step (c) approximates the preferred flash pressure for the corresponding pressure reduction stage when employing an expansion valve and the downstream pressure of step (a) is selected such that the energy generated in this step is sufficient to compress the gas stream of step (b) to said preferred flash pressure. By employing this criteria, inlet pressures to the methane compressor in the open cycle remain similar whether the pressure reduction means are expansion valves or liquid expanders. This allows for switching from one mode of operation to the other and is particularly beneficial when one or more of the expanders must be taken off line, such as for repairs. In the preceding embodiments, it is preferable that the energy be transferred between compressor and expander via electronic, hydraulic or mechanical coupling, more preferably via hydraulic or mechanical coupling, and most preferably via mechanical coupling. When employing expansion valves and three pressure reduction or flash stages, a reduction in pressure of 28 to 42% across each stage is preferred. More preferred is a pressure reduction of 28 to 33% across the high stage, 29 to 34% across the intermediate stage, and 36 to 42% across the low stage. As an example, for an LNG-bearing stream at an elevated pressure of about 600 psia, representative flash pressures are 190, 61 and 24.7 psia.

In a yet another preferred embodiment of the current invention, on LNG-bearing stream produced at elevated pressure is flashed in an open methane refrigeration cycle via multiple stages of pressure reduction to a near-atmospheric pressure by the steps of (a) cooling via indirect heat exchange the LNG-bearing stream produced at elevated pressure thereby producing a cooled LNG-bearing stream; (b) flashing said cooled LNG-bearing stream in an expander thereby generating a first pressure reduction two-phase stream and mechanical energy; (c) separating said first pressure reduction two-phase stream into a first gas stream and a second LNG-bearing stream; (d) warming said first gas stream via indirect heat exchange with the stream of step (a) thereby producing a warmed first gas stream; (e) compressing said warmed gas stream via a compressor thereby producing a compressed first gas stream and wherein said compressor is powered at least in part by energy of step (b); (f) returning said compressed first gas stream to the high stage inlet port of the multi-stage compressor employed in the open methane refrigeration cycle; (g) cooling via indirect heat exchange the second LNG-bearing stream thereby producing a cooled second LNG-bearing stream; (h) flashing said cooled LNG-bearing stream via an expansion valve thereby generating a second pressure reduction two-phase stream; (i) separating said second pressure reduction two-phase stream into a second gas stream and a third LNG-bearing stream; (j) warming said second gas stream via indirect heat exchange with the stream of step (g) thereby producing a warmed second gas stream; (k) returning said warmed second gas stream to the intermediate stage inlet port of the multi-stage compressor employed in the open methane refrigeration cycle; (l) cooling via indirect heat exchange the third LNG-bearing stream thereby producing a cooled third LNG-bearing stream; (m) flashing said cooled LNG-bearing stream via an expansion valve thereby generating a third pressure reduction two-phase stream; (n) separating said third pressure reduction two-phase stream into a third gas stream and a fourth LNG-bearing stream; (o) flowing said fourth LNG-bearing stream to storage; (p) warming said third gas stream via indirect heat exchange with the stream of step (l) thereby producing a warmed third gas stream; and (q) returning said warmed third gas stream to the low stage inlet port of the multi-stage compressor employed in the open methane refrigeration cycle. In a preferred embodiment of the preceding, the process further comprises (r) warming said warmed second gas stream of step (j) via indirect heat exchange with the stream of step (a). In another preferred embodiment, the process further comprises (r) warming said warmed third gas stream of step (p) via indirect heat exchange with the stream of step (g). In yet another preferred embodiment, the process further comprises (r) warming said warmed second gas stream of step (j) via indirect heat exchange with the stream of step (a); and (s) warming said warmed third gas stream of step (p) via indirect heat exchange with the stream of step (g). In yet another preferred embodiment, the process further comprises (t) further warming said warmed second gas stream of step (j) via indirect heat exchange with the stream of step (a). A yet more preferred embodiment of the preceding embodiments is a process wherein the energy of step (a) is the sole source of energy for the compression step of step (e). In the preceding embodiments, it is preferable that the energy be transferred between compressor and expander via electronic, hydraulic or mechanical coupling, more preferably via hydraulic or mechanical coupling, and most preferably via mechanical coupling. And a yet more preferable embodiment of the preceding embodiments is wherein the pressure of said compressed first gas stream of step (e) approximates the preferred flash pressure for the first stage pressure reduction when employing expansion valves in all stages and the downstream pressure of step (b) is selected such that the energy generated in this step is sufficient to compress the gas stream of step (d) to said preferred flash pressure. By employing this criteria, inlet pressures to the methane compressor in the open cycle remain similar whether the pressure reduction means are expansion valves or liquid expanders. This allows for switching from one mode of operation to the other and is particularly beneficial when one or more expanders must be taken off line, such as for repairs.

In another preferred embodiment of the current invention, the LNG-bearing stream produced at elevated pressure is flashed in an open methane refrigeration cycle via multiple stages of pressure reduction to a near-atmospheric pressure by the steps of (a) cooling via indirect heat exchange the pressurized LNG-bearing stream thereby producing a cooled LNG-bearing stream; (b) flashing said cooled LNG-bearing stream in an expander thereby generating a first pressure reduction two-phase stream and energy; (c) separating said first pressure reduction two-phase stream into a first gas stream and a second LNG-bearing stream; (d) warming said first gas stream via indirect heat exchange with the stream of step (a) thereby producing a warmed first gas stream; (e) compressing said warmed gas stream via a compressor thereby producing a compressed first gas stream and wherein said compressor is powered at least in part by energy of step (a); (f) returning said compressed first gas stream to the high stage inlet port of the multi-stage compressor employed in the open methane refrigeration cycle; (g) cooling via indirect heat exchange the second LNG-bearing stream thereby producing a cooled second LNG-bearing stream; (h) flashing said cooled LNG-bearing stream in an expander thereby generating a first pressure reduction two-phase stream and energy; (i) separating said second pressure reduction two-phase stream into a second gas stream and a third LNG-bearing stream; (j) warming said second gas stream via indirect heat exchange with the stream of step (g) thereby producing a warmed second gas stream; (k) compressing said warmed second gas stream via a compressor thereby producing a compressed second gas stream and wherein said compressor is powered at least in part by energy of step (h); (l) returning said warmed second gas stream to the intermediate stage inlet port of the multi-stage compressor employed in the open methane refrigeration cycle; (m) cooling via indirect heat exchange the third LNG-bearing stream thereby producing a cooled third LNG-bearing stream; (n) flashing said cooled LNG-bearing stream via an expansion valve thereby generating a third pressure reduction two-phase stream; (o) separating said third pressure reduction two-phase stream into a third gas stream and a fourth LNG-bearing stream; (p) flowing said fourth LNG-bearing stream to storage; (q) warming said third gas stream via indirect heat exchange with the stream of step (m) thereby producing a warmed third gas stream; and (r) returning said warmed third gas stream to the low stage inlet port of the multi-stage compressor employed in the open methane refrigeration cycle. In a preferred embodiment of the preceding, the process further comprises (s) warming said warmed second gas stream of step (j) via indirect heat exchange with the stream of step (a). In another preferred embodiment, the process further comprises (s) warming said warmed third gas stream of step (m) via indirect heat exchange with the stream of step (g). In yet another preferred embodiment, the process further comprises (t) warming said warmed second gas stream of step (s) via indirect heat exchange with the stream of step (a). In yet another preferred embodiment, the process further comprises (u) warming said warmed third gas stream of step (j) via indirect heat exchange with the stream of step (a). A yet more preferred embodiment of the preceding embodiments is a process wherein the energy of step (a) is the sole source of energy for the compression step of step (e) and the energy of step (h) is the sole source of energy for the compression of step (k). In the preceding embodiments, it is preferable that the energy be transferred between compressor and expander via electronic, hydraulic or mechanical coupling, more preferably via hydraulic or mechanical coupling, and most preferably via mechanical coupling. And a yet more preferable embodiment of the preceding embodiments is wherein the pressure of said compressed first gas of step (e) approximates the flash pressure for the first step pressure reduction when employing expansion valves in all stages and the downstream pressure of step (b) is selected such that the energy generated in this step is sufficient to compress the gas stream of step (d) to said flash pressure and wherein the pressure of said gas of step (k) approximates the flash pressure for the second stage pressure reduction when employing expansion valves in all stages of pressure reduction and the pressure of step (h) is selected such that the energy generated in this step is sufficient to compress the gas stream of step (j)to said preferred flash pressure for the pressure reduction stage of interest. By employing this criteria, inlet pressures to the methane compressor in the open cycle remain similar whether the pressure reduction means are expansion valves or liquid expanders. This allows for switching from one mode of operation to the other and is particularly beneficial when one or more expanders must be taken off line, such as for repairs.

Preferred Open-Cycle Embodiment of Cascaded Liquefaction Process

Figure 2:
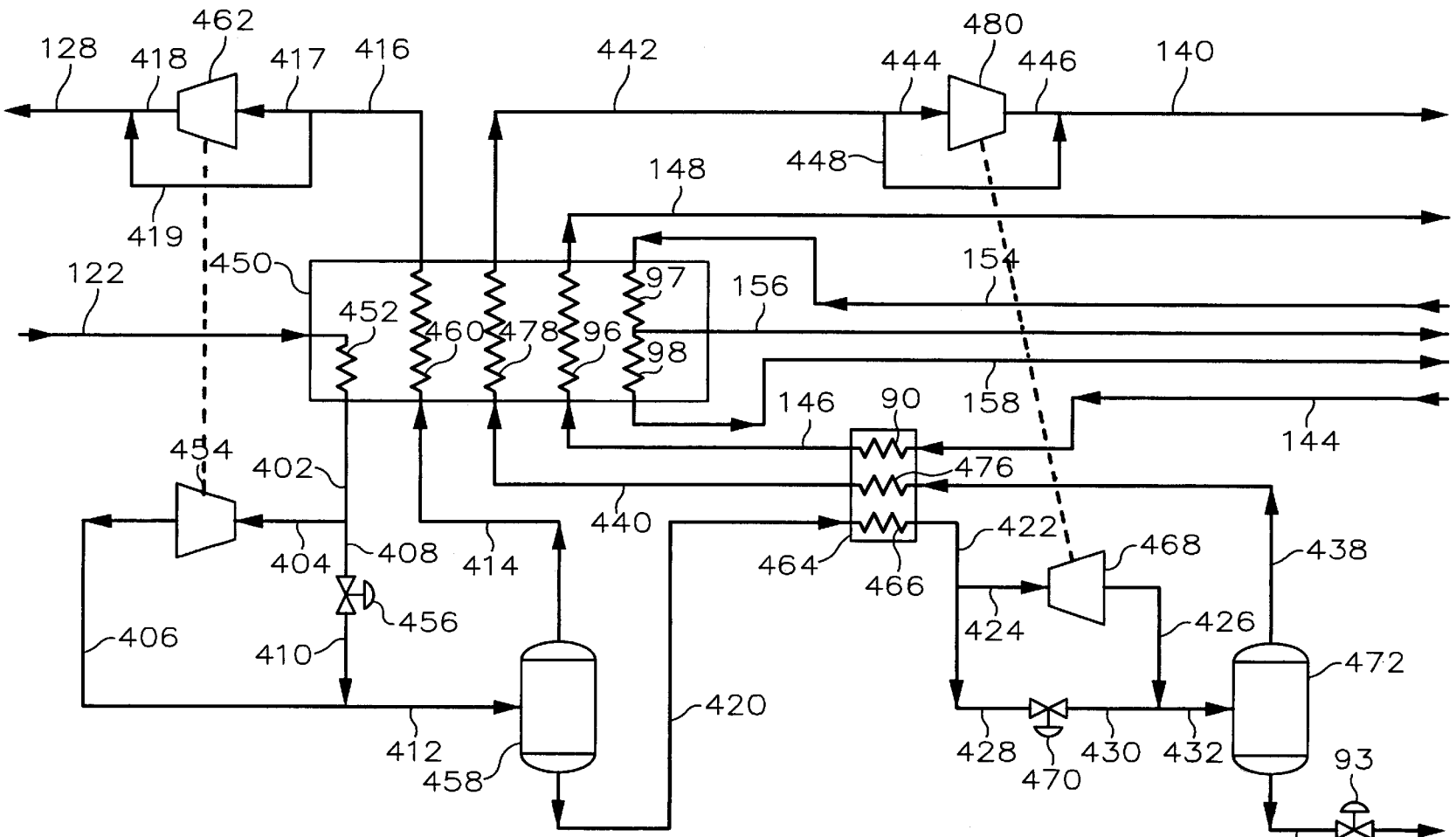
FIG. 2 is a simplified flow diagram which illustrates the methodology and apparatus of the present invention.

The flow schematic and apparatus set forth in FIGS. 1 and 2 is a preferred embodiment of the current invention and is set forth for illustrative purposes. Purposely omitted from the preferred embodiment is a nitrogen removal system, because such system is dependent on the nitrogen content of the feed gas. However as noted in the previous discussion of nitrogen removal technologies, methodologies applicable to this preferred embodiment are readily available to those skilled in the art. Those skilled in the art will also recognized that FIGS. 1 and 2 are schematics only and therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of the FIG. 1, items numbered 1 thru 99 are process vessels and equipment directly associated with the liquefaction process. Items numbered 100 thru 199 correspond to flow lines or conduits which contain methane in major portion. Items numbered 200 thru 299 correspond to flow lines or conduits which contain the refrigerant ethylene. Items numbered 300–399 correspond to flow lines or conduits which contain the refrigerant propane.

A feed gas, as previously described, is introduced to the system through conduit 100. Gaseous propane is compressed in multistage compressor 18 driven by a gas turbine driver which is not illustrated. The three stages preferably form a single unit although they may be separate units mechanically coupled together to be driven by a single driver. Upon compression, the compressed propane is passed through conduit 300 to cooler 20 where it is liquefied. A representative pressure and temperature of the liquefied propane refrigerant prior to flashing is about 100° F. and about 190 psia. Although not illustrated in FIG. 1, it is preferable that a separation vessel be located downstream of cooler 20 and upstream of expansion valve 12 for the removal of residual light components from the liquefied propane. Such vessels may be comprised of a single-stage gas liquid separator or may be more sophisticated and comprised of an accumulator section, a condenser section and an absorber section, the latter two of which may be continuously operated or periodically brought on-line for removing residual light components from the propane. The stream from this vessel or the stream from cooler 20, as the case may be, is pass through conduit 302 to a pressure reduction means such as a expansion valve 12 wherein the pressure of the liquefied propane is reduced thereby evaporating or flashing a portion thereof. The resulting two-phase product then flows through conduit 304 into high-stage propane chiller 2 wherein indirect heat exchange with gaseous methane refrigerant introduced via conduit 152, natural gas feed introduced via conduit 100 and gaseous ethylene refrigerant introduced via conduit 202 are respectively cooled via indirect heat exchange means 4, 6 and 8 thereby producing cooled gas streams respectively produced via conduits 154, 102 and 204.

The flashed propane gas from chiller 2 is returned to compressor 18 through conduit 306. This gas is fed to the high stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to chiller 22 through conduit 310 thereby providing a coolant for chiller 22.

The cooled feed gas stream from chiller 2 flows via conduit 102 to a knock-out vessel 10 wherein gas and liquid phases are separated. The liquid phase which is rich in C3+ components is removed via conduit 103. The gaseous phase is removed via conduit 104 and conveyed to propane chiller 22. Ethylene refrigerant is introduced to chiller 22 via conduit 204. In the chiller, the methane-rich process stream and an ethylene refrigerant stream are respectively cooled via indirect heat exchange means 24 and 26 thereby producing cooled methane-rich process stream and an ethylene refrigerant stream via conduits 110 and 206. The thus evaporated portion of the propane refrigerant is separated and passed through conduit 311 to the intermediate-stage inlet of compressor 18. Liquid propane is passed through conduit 312, the pressure further reduced by passage through a pressure reduction means, illustrated as expansion valve 16, whereupon an additional portion of liquefied propane is flashed. The resulting two-phase stream is then fed to chiller 28 through conduit 314 thereby providing coolant to chiller 28.

As illustrated in FIG. 1, the methane-rich process stream flows from the intermediate-stage propane chiller 22 to the low-stage propane chiller/condenser 28 via conduit 110. In this chiller, the stream is cooled via indirect heat exchange means 30. In a like manner, the ethylene refrigerant stream flows from the intermediate-stage propane chiller 22 to the low-stage propane chiller/condenser 28 via conduit 206. In the latter, the ethylene refrigerant is condensed via an indirect heat exchange means 32 in nearly its entirety. The vaporized propane is removed from the low-stage propane chiller/condenser 28 and returned to the low-stage inlet at the compressor 18 via conduit 320. Although FIG. 1 illustrates cooling of streams provided by conduits 110 and 206 to occur in the same vessel, the chilling of stream 110 and the cooling and condensing of stream 206 may respectively take place in separate process vessels (ex., a separate chiller and a separate condenser, respectively).

As illustrated in FIG. 1, a portion of a cooled compressed methane recycle stream is provided via conduit 156, combined with the methane-rich process stream exiting the low-stage propane chiller via conduit 112 and the combined methane-rich process stream is introduced to the high-stage ethylene chiller 42 via conduit 114. Ethylene refrigerant exits the low-stage propane chiller 28 via conduit 208 and is fed to a separation vessel 37 wherein light components are removed via conduit 209 and condensed ethylene is removed via conduit 210. The separation vessel is analogous to the earlier discussed for the removal of light components from liquefied propane refrigerant and may be a single-stage gas/liquid separator or may be a multiple stage operation resulting in a greater selectivity of the light components removed from the system. The ethylene refrigerant at this location in the process is generally at a temperature of about −24° F. and a pressure of about 285 psia. The ethylene refrigerant via conduit 210 then flows to the main ethylene economizer 34 wherein it is cooled via indirect heat exchange means 38 and removed via conduit 211 and passed to a pressure reduction means such as an expansion valve 40 whereupon the refrigerant is flashed to a preselected temperature and pressure and fed to the high-stage ethylene chiller 42 via conduit 212. Vapor is removed from this chiller via conduit 214 and routed to the main ethylene economizer 34 wherein the vapor functions as a coolant via indirect heat exchange means 46. The ethylene vapor is then removed from the ethylene economizer via conduit 216 and feed to the high-stage inlet on the ethylene compressor 48. The ethylene refrigerant which is not vaporized in the high-stage ethylene chiller 42 is removed via conduit 218 and returned to the ethylene main economizer 34 for further cooling via indirect heat exchange means 50, removed from the main ethylene economizer via conduit 220 and flashed in a pressure reduction means illustrated as expansion valve 52 whereupon the resulting two-phase product is introduced into the low-stage ethylene chiller 54 via conduit 222. The combined methane-rich process stream is removed from the high-stage ethylene chiller 42 via conduit 116 and directly fed to the low-stage ethylene chiller 54 wherein it undergoes additional cooling and partial condensation via indirect heat exchange means 56. The resulting two-phase stream then flows via conduit 118 to a two phase separator 60 from which is produced a methane-rich vapor stream via conduit 119 and via conduit 117, a liquid stream rich in $C_2$+ components which is subsequently flashed or fractionated in vessel 67 thereby producing via conduit 123 a heavies stream and a second methane-rich stream which is transferred via conduit 121 and after combination with a second stream via conduit 128 is fed to the high pressure inlet port on the methane compressor 83.

The stream in conduit 119 and a cooled compressed methane recycle stream provided via conduit 158 are combined and fed via conduit 120 to the low-stage ethylene condenser 68 wherein this stream exchanges heat via indirect heat exchange means 70 with the liquid effluent from the low-stage ethylene chiller 54 which is routed to the low-stage ethylene condenser 68 via conduit 226. In condenser 68, the combined streams are condensed and produced from condenser 68 via conduit 122. The vapor from the low-stage ethylene chiller 54 via conduit 224 and low-stage ethylene condenser 68 via conduit 228 are combined and routed via conduit 230 to the main ethylene economizer 34 wherein the vapors function as a coolant via indirect heat exchange means 58. The stream is then routed via conduit 232 from the main ethylene economizer 34 to the low-stage side of the ethylene compressor 48. As noted in FIG. 1, the compressor effluent from vapor introduced via the low-stage side is removed via conduit 234, cooled via inter-stage cooler 71 and returned to compressor 48 via conduit 236 for injection with the high-stage stream present in conduit 216. Preferably, the two-stages are a single module although they may each be a separate module and the modules mechanically coupled to a common driver. The compressed ethylene product from the compressor is routed to a downstream cooler 72 via conduit 200. The product from the cooler flows via conduit 202 and is introduced, as previously discussed, to the high-stage propane chiller 2

The liquefied stream in conduit 122 is generally at a temperature of about −125° F. and about 600 psi. This stream passes via conduit 122 through the main methane economizer 74 wherein the stream is further cooled by indirect heat exchange means 76 as hereinafter explained. From the main methane economizer 74 the cooled liquefied stream passes through conduit 124 and its pressure is reduced by a pressure reductions means which is illustrated as expansion valve 78, which of course evaporates or flashes a portion of the gas stream. The flashed stream is then passed to methane high-stage flash drum 80 where it is separated into a gas phase discharged through conduit 126 and a liquid phase discharged through conduit 130. The gas-phase is then transferred to the main methane economizer via conduit 126 wherein the vapor functions as a coolant via indirect heat exchange means 82. The vapor exits the main methane economizer via conduit 128 where it is combined with the gas stream delivered by conduit 121. These streams are then fed to the high pressure side of compressor 83. The liquid phase in conduit 130 is passed through a second methane economizer 87 wherein the liquid is further cooled by downstream flash vapor via indirect heat exchange means 88. The cooled liquid exits the second methane economizer 87 via conduit 132 and is expanded or flashed via pressure reduction means illustrated as expansion valve 91 to further reduce the pressure and at the same time, evaporate or flash a second portion thereof This flash stream is then passed to intermediate-stage methane flash drum 92 where the stream is separated into a gas phase passing through conduit 136 and a liquid phase passing through conduit 134. The gas phase flows through conduit 136 to the second methane economizer 87 wherein the vapor cools the liquid introduced to 87 via conduit 130 via indirect heat exchanger means 89. Conduit 138 serves as a flow conduit between indirect heat exchange means 89 in the second methane economizer 87 and the indirect heat exchange means 95 in the main methane economizer 74. This vapor leaves the main methane economizer 74 via conduit 140 which is connected to the indirect heat exchange means 95 and the intermediate stage inlet on the methane compressor 83. The liquid phase exiting the intermediate stage flash drum 92 via conduit 134 is further reduced in pressure, preferably to about 25 psia, by passage through a pressure reduction means illustrated as a expansion valve 93. Again, a third portion of the liquefied gas is evaporated or flashed. The fluids from the expansion valve 93 are passed to final or low stage flash drum 94. In flash drum 94, a vapor phase is separated and passed through conduit 144 to the second methane economizer 87 wherein the vapor functions as a coolant via indirect heat exchange means 90, exits the second methane economizer via conduit 146 which is connected to the first methane economizer 74 wherein the vapor functions as a coolant via indirect heat exchange means 96 and ultimately leaves the first methane economizer via conduit 148 which is connected to the low pressure port on compressor 83. The liquefied natural gas product from flash drum 94 which is at approximately atmospheric pressure is passed through conduit 142 to the storage unit. The low pressure, low temperature LNG boil-off vapor stream from the storage unit is preferably recovered by combining such stream with the low pressure flash vapors present in either conduits 144, 146, or 148; the selected conduit being based on a desire to match vapor stream temperatures as closely as possible.

As shown in FIG. 1, the high, intermediate and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas is discharged from high stage methane compressor through conduit 150, is cooled in cooler 86 and is routed to the high pressure propane chiller 2 via conduit 152 as previously discussed. The stream is cooled in chiller 2 via indirect heat exchange means 4 and flows to the main methane economizer via conduit 154. As used herein and previously noted, compressor refers to each stage of compression and any equipment associated with interstage cooling.

The stream entering the main methane economizer 74 undergoes cooling in its entirety via flow through indirect heat exchange means 97. A portion of the cooled stream is removed via conduit 156 and returned to the natural gas stream undergoing processing upstream of the first stage (i.e., high pressure) of ethylene cooling. The remaining portion undergoes further cooling via indirect heat transfer mean 98 in the main methane economizer and is produced therefrom via conduit 158. This stream is combined with the natural gas stream undergoing processing at a location in the final stage (i.e., low pressure) of ethylene cooling, preferably downstream of the ethylene chiller 54 and upstream of the ethylene condenser 68. The combined stream then undergoes liquefaction in major portion in the ethylene condenser 68 via flow through indirect heat exchange means 70.

As used herein, reference to separate indirect heat exchange means for the cooling or heating of a given stream also includes, but is not limited to, a common indirect heat exchanger means. As an example, indirect heat exchange means A and B may refer to a single plate fine heat exchanger wherein the two streams fed to each means undergo heat exchange therein with one another.

FIG. 1 depicts the expansion of the liquefied phase using expansion valves with subsequent separation of gas and liquid portions in the chiller or condenser. While this simplified scheme is workable and utilized in some cases, it is often more efficient and effective to carry out partial evaporation and separation steps in separate equipment, for example, an expansion valve and separate flash drum might be employed prior to the flow of either the separated vapor or liquid to a propane chiller. In a like manner, certain process streams undergoing expansion are ideal candidates for employment of a hydraulic expander as part of the pressure reduction means thereby enabling the extraction of work and also lower two-phase temperatures.

With regard to the compressor/driver units employed in the process, FIG. 1 depicts individual compressor/driver units (i.e., a single compression train) for the propane, ethylene and open methane cycle compression stages. However in a preferred embodiment for any cascaded process, process reliability can be improved significantly by employing a multiple compression train comprising two or more compressor/driver combinations in parallel in lieu of the depicted single compressor/driver units. In the event that a compressor/driver unit becomes unavailable, the process can still be operated at a reduced capacity. In addition by shifting loads among the compressor/driver units in the manner herein disclosed, the LNG production rate can be further increased when a compressor/driver unit goes down or must operate at reduced capacity.

FIG. 2 illustrates a preferred embodiment of the inventive pressure reduction process and associated apparatus herein claimed. An LNG-bearing stream at elevated pressure is delivered via conduit 122 to the first methane economizer 450 wherein is contained indirect heat exchange means 452, 460, 478 and previously identified indirect heat exchange means 96, 97, and 98 and wherein each such means is in thermal contact with at least one other means. Conduit 122 is connected to first indirect heat exchange means 452 and the fluid therein flows generally countercurrent and preferably countercurrent to the fluid streams in indirect heat exchange means 460, 478 and 96 thereby producing a cooled LNG-bearing stream via conduit 402. The cooled LNG-bearing stream then flows via conduit 402 to a flow direction means (not numbered) whereupon the stream flows either via conduit 404 to liquid expander 454 thereby producing a first pressure reduction two-phase stream via conduit 406 or said cooled LNG-bearing stream flows from said splitting means via conduit 408 to expansion valve 456 thereby producing a first pressure reduction two-phase stream via conduit 410. Conduits 406 and 410 are combined at a junction means (not numbered) and the two phase stream routed via conduit 412 to the first gas-liquid separator 458. Produced from the first gas liquid separator via conduit 414 is a first gas stream and via conduit 420 is a second LNG-bearing stream. The first gas stream in conduit 414 is routed through indirect heat exchange means 460 in the first methane economizer 450 thereby producing a warmed first gas stream which is routed via conduit 416 to a flow direction means to which are connected conduits 417 and 419. When flow in conduit 416 is routed via the flow direction means to conduit 417 which is connected to compressor 462, a pressurized first gas stream is produced via conduit 418 which is connected to compressor 462. Compressor 462 is mechanically coupled to expander 454. Conduit 418 is then connected to a junction means (not numbered) which is in turn connected to conduit 128. The pressurized first gas stream in conduit 128 is ultimately fed to the inlet port on the high pressure stage of the methane compressor 83. When the compressor 462 is not in operation, the warmed first gas stream can bypass the compressor via the flow direction means providing flow continuity via conduits 416 and 419 and conduit 419 is in turn connected to the previously described junction means which is in flow communication with conduit 128 thereby allowing said warmed first gas stream to be returned to the inlet port of the high pressure stage of the methane compressor 83.

The second LNG-bearing stream in conduit 420 is then routed to the indirect heat exchange mean 466 in the second methane economizer 464 wherein said stream is in indirect heat exchange with a yet to be identified stream and a previously identified stream in indirect heat exchange means 90 where such streams flow generally countercurrent and preferably countercurrent to said stream thereby producing via conduit 422 a cooled second LNG-bearing stream. In a manner similar to the cooled first LNG-bearing stream, the cooled second LNG-bearing stream is routed to a flow direction means to which are connect conduits 424 and 428. The stream in conduit 424 is routed to the second expander thereby producing a second pressure reduction two-phase stream via conduit 426 which is connected to a junction means (not numbered). The cooled second LNG-bearing stream may also be routed from the flow direction means via conduit 428 to expansion valve 470 from which is produced via conduit 430 a second pressure reduction two-phase stream. This stream is routed via conduit 430 to the junction means to which conduit 426 is connected. The two phase stream exits said junction means via conduit 432. The second pressure reduction two-phase stream is routed via conduit 432 to second gas-liquid separator 472 from which is produced a second gas stream via conduit 438 and a third LNG-bearing stream via previously cited conduit 134. The third LNG-bearing stream is then flashed via expansion valve 93 to near atmospheric pressure, separated into gas and liquid phases and the liquid phase routed to storage.

The second gas stream is routed via conduit 438 to indirect heat exchange means 476 in the second methane economizer 464 wherein said stream is in thermal contact with the second LNG-bearing stream in indirect heat exchange means 466. Produced from indirect heat exchange means 476 via conduit 440 is a warmed second gas stream. This gas stream is routed via conduit 440 to indirect heat exchange means 478 wherein said stream is warmed via thermal contact with at least the first LNG-bearing stream in indirect heat exchange means 452 and wherein said streams flow generally countercurrent and preferably countercurrent to one another. Produced from the indirect heat exchange means 478 via conduit 442 is a further warmed third gas stream. Said conduit is connected to a flow direction means (not numbered) to which are connected conduits 444 and 448. When the flow direction means so provides, the further warmed second gas stream flows via conduit 444 to compressor 480 which is mechanically coupled to second expander 468 thereby producing a pressurized second gas stream. This stream is routed via conduit 446 through a junction means which is not illustrated and which is connected to conduit 140 which is in flow communication with the intermediate stage inlet port on methane compressor 83. When compressor 480 is not in operation, the further warmed second gas stream can bypass the compressor via the flow direction means providing flow continuity via conduits 442 and 448 and conduit 448 is in turn connected to the previously described junction means which is in flow continuity with conduit 140 thereby allowing said further warmed second gas stream to be returned to the inlet port of the intermediate pressure stage of methane compressor 83.

As used herein, flow direction means refers to any equipment available to those skilled in the art for routing fluid in one conduit into one of at least two alternative conduits. Flow direction means includes but is not limited to three-way valves, flow control valves, hand valves, multiport valves and associated hardware which direct fluid from one conduit into one of at least two conduits. As used herein, junction means refers to any equipment available in the art for combining flows in two or more conduits into a single conduit and includes, but is not limited to conduits connected by T's and Y's. Although the preceding set forth the use of a flow direction means for splitting and directing flow and a downstream junction means for combining or joining the possible flow routes via a common junction, a similar result can be obtained by reversing the order, that being placing the flow direction means downstream of the junction means. Such an arrangement is also within the scope of the current invention.

Various items depicted in FIG. 1 and FIG. 2 perform similar functions but are identified by a different item number. As an example, items performing similar functions are 76/452, 78/456, 80/458, 82/460, 88/466, 89/476, 91/470, 92/472, and 95/478. It is readily within the abilities of one possessing ordinary skill in the art to incorporate the methodology and apparatus illustrated in FIG. 2 into the methodology and apparatus illustrated in FIG. 1. As previously noted, a key aspect of the current invention is the employment of liquid expanders at key locations in the process and the strategic employment of the energy generated by such expanders in the process.

While specific cryogenic methods, materials, items of equipment and control instruments are referred to herein, it is to be understood that such specific recitals are not to be considered limiting but are included by way of illustration and to set forth the best mode in accordance with the presence invention.

EXAMPLE I

This example shows via computer simulation of the cascade process for LNG production the benefits of employing the inventive methodology and apparatus herein claimed. Four cases are illustrated.

Simulation results were obtained using Hyprotech's Process Simulation HYSIM, version C2.54, Prop. Pkg PR/LK. The simulations were based on the open methane cycle. The simulator was configured to model a liquefaction process similar to that presented in FIG. 1. Refrigerants employed in the first and second cycles were propane and ethylene, respectively. The propane cycle employed three stages of cooling whereas the ethylene employed two stages of cooling. The open methane cycle was configured to employed three distinct flash steps and therefore, required three stages of compression.

In Case A, the pressurized LNG was expanded using the methodology set forth in the prior art; that being the employment of economizers for the cooling of streams to be flashed via indirect contact with downstream flash vapors and expansion via Joule Thompson expansion valves.

In Case B, a liquid expander was substituted for the Joule Thompson valve employed for the high stage expansion of pressurized LNG. This stream was expanded to the same pressure as that resulting from the high stage flash in Case A. The energy generated by the high stage expansion was not designated for any specific purpose. A 75% adiabatic efficiency was assumed for the liquid expander.

In Case C, a liquid expander was also employed for the high stage expander. The expansion pressure was selected such that the energy generated by the expander was sufficient to directly compress the flash gases, after heat exchange, to the pressure of the flash gas of Case A (i.e., the expander would drive the compressor of interest). Stated differently, the selection of operating parameters provides that the suction pressure at the high pressure inlet side of the methane compressor will be the same in either Case A or Case C, thereby allowing plant operation to shift between Case A and Case C. Therefore in the event that repairs to the expander of interest is required, continued plant operation without significant pressure changes in the open methane cycle will be possible by employing expansion valves for the high stage expansion step. For the Case C simulations, a 75% adiabatic efficiency was assumed for the expanders and a 72% adiabatic efficiency for the compressor.

Case D is similar to Case C with the exception that a liquid expander has been substituted for the Joule Thompson valve in the second stage or intermediate stage flash step and the pressure of this stage has been reduced such that the power generated by the expander is sufficient to compress the resulting flash vapors, after heat exchange, to the analogous pressure following the second stage expansion in Case A (i.e., the base case). Again, the advantage of such an operating scenario being the operational ease of transferring plant operation between the Case A which employs Joule Thompson valves for expansion and the more energy efficient Case D which employs liquid expanders for the high and intermediate stage flashes. Again as for Case C, it was assumed that the expander would be coupled to the compressor of interest. This methodology and corresponding apparatus is illustrated in FIG. 2 in schematic form. The expander and compressor efficiencies employed in the simulation for Case D were the same as for Case C (i.e., 75% adiabatic for liquid expander, 72% adiabatic for the compressor). Temperatures and pressures of key process for the four simulated cases are presented in Table 1.

TABLE 1

| | Simulated Temperatures and Pressures | | | | | | | |
|---|---|---|---|---|---|---|---|---|
| | Case A | | Case B | | Case C | | Case D | |
| Line | T(° F.) | P (psia) | T(° F.) | P (psia) | T(° F.) | P (psia) | T(° F.) | P (psia) |
| 402 | −130.9 | 608.2 | −130.5 | 608.2 | −131.9 | 608.2 | −131.7 | 608.2 |
| 412 | −173.5 | 216.8 | −173.5 | 216.8 | −181.6 | 179.5 | −181.6 | 179.5 |
| 416 | 56.9 | 210.8 | 56.9 | 210.8 | 57.0 | 173.5 | 55.4 | 173.5 |

TABLE 1-continued

| | Simulated Temperatures and Pressures | | | | | | | |
|---|---|---|---|---|---|---|---|---|
| | Case A | | Case B | | Case C | | Case D | |
| Line | T(° F.) | P (psia) | T(° F.) | P (psia) | T(° F.) | P (psia) | T(° F.) | P (psia) |
| 418 | 56.9 | 210.8 | 56.9 | 210.8 | 90.3 | 210.8 | 88.7 | 210.8 |
| 422 | −181.0 | 211.8 | −181.0 | 211.8 | −187.7 | 174.5 | −187.6 | 174.5 |
| 432 | −215.1 | 72.6 | −215.1 | 72.6 | −215.1 | 72.6 | −218.8 | 64.6 |
| 438 | −215.1 | 72.6 | −215.1 | 72.6 | −215.1 | 72.6 | −218.8 | 64.6 |
| 440 | −177.5 | 69.6 | −177.5 | 69.6 | −185.6 | 69.6 | −185.6 | 61.6 |
| 442 | 57.0 | 64.6 | 57.0 | 64.6 | 57.0 | 64.6 | 55.5 | 56.6 |
| 446 | 57.0 | 64.6 | 57.0 | 64.6 | 57.0 | 64.6 | 80.9 | 64.6 |

Other than the addition of the expander/compressor combination, the process variables and plant throughput were maintained constant for the four cases. No attempt was made to match equipment performance.

TABLE 2

| CASE DESCRIPTION | CASE A | CASE B | CASE C | CASE D |
|---|---|---|---|---|
| High Stage Expander | N/A | Yes | Yes | Yes |
| Expansion Ratio | N/A | 2.81 | 3.39 | 3.39 |
| Expander Work produced, HP | 0 | 2854 | 3362 | 3338 |
| Inter Stage Expander | N/A | N/A | N/A | Yes |
| Expansion Ratio | N/A | N/A | N/A | 2.70 |
| Expander Work Produced, HP | 0 | 0 | 0 | 759 |
| Savings in Overall Comp. BHP | 0 | 5199 | 7451 | 9827 |
| % Savings in Overall Comp. BHP | 0.0 | 2.9 | 4.2 | 5.5 |

As shown in Case B, placing a liquid expander at the high stage methane loop leads to an approximate 3% savings in overall compression HP. If the load in all three refrigerant loops can be totally shared, the 3% savings in HP reflects a potential increase in LNG production by 3% ideally.

By utilizing the expander work to recompress the flashed vapor as in Case C, the following enhancement over Case B can be realized:

The pressure in HS flash drum, namely expander discharge, drops by almost 40 psi to 180 psia.

The drop in discharge pressure leads to a higher expansion ratio and an addition of 508 HP can be generated by the expander.

Overall savings in all three refrigeration compression increase by 1.3% from 2.9%, including 2.6% for the methane loop, 0.6% for the ethylene loop, and 0.5% for the propane loop.

The flashed vapor rate increases from 211.9 MMSCFD to 224.2 MMSCFD, closer to the original design of 243.2 MMSCFD, and less fluctuation in compressor performance would be expected should the expander-compressor fail.

A similar effect can be realized when the expander/compressor combination is placed in the inner stage methane loop, as indicated in Case D. The net savings in overall HP or potential increase in LNG production is approximately 1.3%.

That which is claimed is:

1. In a process wherein a LNG-bearing stream is produced at an elevated pressure and said stream is flashed in an open methane refrigeration cycle employing a multi-stage compressor via multiple stages of pressure reduction to a near-atmospheric pressure and employing a multi-stage compression step, the improvement comprising in at least one of said pressure reduction stages:

(a) flashing a pressurized LNG-bearing stream in an expander thereby generating a two-phase stream and energy;

(b) separating said two-phase stream into a gas stream and lower pressure predominantly LNG-bearing stream;

(c) compressing said gas stream in a compressor thereby producing a pressurized gas stream and wherein said compressor is powered at least in part by the energy of step (a); and (d) returning said pressurized gas stream to the multi-stage compression step employed in the open methane refrigeration cycle.

2. A process according to claim 1 wherein said energy is mechanical energy, hydraulic energy or electrical energy.

3. A process according to claim 2 wherein the energy of step (a) is the sole source of energy for the compression step of step (c).

4. A process according to claim 2 wherein steps (a)–(d) are employed in at least the first pressure reduction stage.

5. A process according to claim 4 wherein said energy is mechanical energy.

6. A process according to claim 4 wherein the energy of step (a) is the sole source of energy for the compression step of step (c).

7. A process according to claim 6 wherein said energy is mechanical energy.

8. A process according to claim 2 wherein said LNG-bearing stream produced at an elevated pressure is flashed to near-atmospheric pressure by three pressure reduction stages and wherein said steps of claim 1 are employed in the first and second pressure reduction stages.

9. A process according to claim 8 wherein the energy of step (a) is the sole source of energy for the compression step of step (c).

10. A process according to claim 2 further comprising the step of (e) contacting via indirect heat exchange means the LNG-bearing stream of step (a) prior to step (a) with the gas stream of step (b) prior to step (c) thereby cooling the LNG-bearing stream and warming the gas stream.

11. A process according to claim 10 wherein said LNG-bearing stream produced at an elevated pressure is flashed to near-atmospheric pressure by three pressure reduction stages and wherein said steps of claim 1 are employed in the first and second pressure reduction stages.

12. A process according to claim 11 wherein the energy of step (a) is the sole source of energy for the compression step of step (c).

13. A process according to claim 12 wherein said energy is mechanical energy.

14. A process according to claim 2 wherein the pressure of said compressed gas of step (c) is selected to approximate the preferred flash pressure for the corresponding stage of pressure reduction when expansion valves are employed in all stages of pressure reduction and the downstream pressure of step (a) is selected such that the energy generated in this step is sufficient to compress the gas stream of step (b) to said preferred flash pressure for the pressure reduction stage of interest.

15. A process according to claim 14 further comprising the step of (e) contacting via indirect heat exchange means the LNG-bearing stream of step (a) prior to step (a) with the gas stream of step (b) prior to step (c) thereby cooling the LNG-bearing stream and warming the gas stream.

16. A process according to claim 15 wherein said LNG-bearing stream produced at an elevated pressure is flashed to near-atmospheric pressure by three pressure reduction stages and wherein said steps of claim 1 are employed in the first and second pressure reduction stages.

17. A process according to claim 16 wherein said energy is mechanical energy.

18. In a process wherein a LNG-bearing stream at elevated pressure is flashed in an open methane refrigeration cycle via multiple stages of pressure reduction to a near-atmospheric pressure, the improvement comprising:

(a) cooling via indirect heat exchange said LNG-bearing stream at elevated pressure thereby producing a cooled LNG-bearing stream;

(b) flashing said cooled LNG-bearing stream in an expander thereby generating a first pressure reduction two-phase stream and energy;

(c) separating said first pressure reduction two-phase stream into a first gas stream and a second LNG-bearing stream;

(d) warming said first gas stream via indirect heat exchange with the stream of step (a) thereby producing a warmed first gas stream;

(e) compressing said warmed gas stream via a compressor thereby producing a compressed first gas stream and wherein said compressor is powered at least in part by energy of step (a);

(f) returning said compressed first gas stream to the high stage inlet port of the multi-stage compressor employed in the open methane refrigeration cycle;

(g) cooling via indirect heat exchange the second LNG-bearing stream thereby producing a cooled second LNG-bearing stream;

(h) flashing said cooled LNG-bearing stream via an expansion valve thereby generating a second pressure reduction two-phase stream;

(i) separating said second pressure reduction two-phase stream into a second gas stream and a third LNG-bearing stream;

(j) warming said second gas stream via indirect heat exchange with the stream of step (g) thereby producing a warmed second gas stream;

(k) returning said warmed second gas stream to the intermediate stage inlet port of the multi-stage compressor employed in the open methane refrigeration cycle;

(l) cooling via indirect heat exchange the third LNG-bearing stream thereby producing a cooled third LNG-bearing stream;

(m) flashing said cooled LNG-bearing stream via an expansion valve thereby generating a third pressure reduction two-phase stream;

(n) separating said third pressure reduction two-phase stream into a third gas stream and a fourth LNG-bearing stream;

(o) flowing said fourth LNG-bearing stream to storage;

(p) warming said third gas stream via indirect heat exchange with the stream of step (l) thereby producing a warmed third gas stream;

(q) returning said warmed third gas stream to the low stage inlet port of the multi-stage compressor employed in the open methane refrigeration cycle.

19. A process according to claim 18 wherein said energy is mechanical energy, hydraulic energy or electrical energy.

20. A process according to claim 19 further comprising:

(r) further warming said warmed second gas stream of step (q) via indirect heat exchange with the stream of step (a).

21. A process according to claim 19 further comprising:
(r) further warming said warmed third gas stream of step (q) via indirect heat exchange with the stream of step (g).

22. A process according to claim 21 further comprising:
(s) further warming said warmed third gas stream of step (r) via indirect heat exchange with the stream of step (a).

23. A process according to claim 22 further comprising:
(t) further warming said warmed second gas stream of step (j) via indirect heat exchange with the stream of step (a).

24. A process according to claim 19 wherein the energy of step (a) is the sole source of energy for the compression step of step (e).

25. A process according to claim 24 wherein said energy is mechanical energy.

26. A process according to claim 20 wherein the energy of step (a) is the sole source of energy for the compression step of step (e).

27. A process according to claim 26 wherein said energy is mechanical energy.

28. A process according to claim 23 wherein the energy of step (a) is the sole source of energy for the compression step of step (e).

29. A process according to claim 28 wherein said energy is mechanical energy.

30. A process according to claim 19 wherein the pressure of said compressed first gas stream of step (e) is selected to approximate the preferred flash pressure for the first stage of pressure reduction when employing expansion valves in all stages of pressure reduction and the pressure of step (b) is selected such that the energy generated in this step is sufficient to compress the gas stream of step (d) to said preferred flash pressure for the pressure reduction stage of interest.

31. A process according to claim 30 wherein said energy is mechanical energy.

32. A process according to claim 20 wherein the pressure of said compressed first gas stream of step (e) is selected to approximate the preferred flash pressure for the first stage of pressure reduction when employing expansion valves in all stages of pressure reduction and the pressure of step (b) is selected such that the energy generated in this step is sufficient to compress the gas stream of step (d) to said preferred flash pressure for the pressure reduction stage of interest.

33. A process according to claim 23 wherein the pressure of said compressed first gas stream of step (e) is selected to approximate the preferred flash pressure for pressure reduction stages when employing expansion valves in all stages of pressure reduction and the pressure of step (b) is selected such that the energy generated in this step is sufficient to compress the gas stream of step (d) to said preferred flash pressure for the pressure reduction stage of interest.

34. In a process wherein a LNG-bearing stream at elevated pressure is flashed in an open methane refrigeration cycle via multiple stages of pressure reduction to a near-atmospheric pressure, the improvement comprising:
(a) cooling via indirect heat exchange the LNG-bearing stream at elevated pressure thereby producing a cooled LNG-bearing stream;
(b) flashing said cooled LNG-bearing stream in an expander thereby generating a first pressure reduction two-phase stream and energy;
(c) separating said first pressure reduction two-phase stream into a first gas stream and a second LNG-bearing stream;
(d) warming said first gas stream via indirect heat exchange with the stream of step (a) thereby producing a warmed first gas stream;
(e) compressing said warmed gas stream via a compressor thereby producing a compressed first gas stream and wherein said compressor is powered at least in part by energy of step (a);
(f) returning said compressed first gas stream to the high stage inlet port of the multi-stage compressor employed in the open methane refrigeration cycle;
(g) cooling via indirect heat exchange the second LNG-bearing stream thereby producing a cooled second LNG-bearing stream;
(h) flashing said cooled LNG-bearing stream in an expander thereby generating a second pressure reduction two-phase stream and energy;
(i) separating said second pressure reduction two-phase stream into a second gas stream and a third LNG-bearing stream;
(j) warming said second gas stream via indirect heat exchange with the stream of step (g) thereby producing a warmed second gas stream;
(k) compressing said warmed second gas stream via a compressor thereby producing a compressed second gas stream and wherein said compressor is powered at least in part by energy of step (h);
(l) returning said warmed second gas stream to the intermediate stage inlet port of the multi-stage compressor employed in the open methane refrigeration cycle;
(m) cooling via indirect heat exchange the third LNG-bearing stream thereby producing a cooled third LNG-bearing stream;
(n) flashing said cooled LNG-bearing stream via an expansion valve thereby generating a third pressure reduction two-phase stream;
(o) separating said third pressure reduction two-phase stream into a third gas stream and a fourth LNG-bearing stream;
(p) flowing said fourth LNG-bearing stream to storage;
(q) warming said third gas stream via indirect heat exchange with the stream of step (m) thereby producing a warmed third gas stream; and
(r) returning said warmed third gas stream to the low stage inlet port of the multi-stage compressor employed in the open methane refrigeration cycle.

35. A process according to claim 34 wherein said energy of steps (b) and (h) is mechanical energy, hydraulic energy or electrical energy.

36. A process according to claim 35 further comprising:
(s) further warming said warmed second gas stream of step (j) via indirect heat exchange with the stream of step (a).

37. A process according to claim 36 further comprising:
(t) further warming said warmed third gas stream of step (q) via indirect heat exchange with the stream of step (a).

38. A process according to claim 37 further comprising:
(u) further warming said warmed second gas stream of step (j) via indirect heat exchange with the stream of step (a).

39. A process according to claim 35 wherein the energy of step (a) is the sole source of energy for the compression step of step (e) and the energy of step (h) is the sole source of energy for the compression step of step (k).

40. A process according to claim 39 wherein said energy is mechanical energy.

41. A process according to claim 36 wherein the energy of step (a) is the sole source of energy for the compression step of step (e) and the energy of step (h) is the sole source of energy for the compression step of step (k).

42. A process according to claim 41 wherein said energy is mechanical energy.

43. A process according to claim 38 wherein the energy of step (a) is the sole source of energy for the compression step of step (e) and the energy of step (h) is the sole source of energy for the compression step of step (k).

44. A process according to claim 43 wherein said energy is mechanical.

45. A process according to claim 35 wherein the pressure of said compressed warmed gas stream of step (e) is selected to approximate the preferred flash pressure for the first stage of pressure reduction when employing expansion valves in all stages of pressure reduction and the pressure of step (b) is selected such that the energy generated in this step is sufficient to compress the gas stream of step (b) to said flash pressure for the first pressure reduction stage of interest and wherein the pressure of said compressed warmed second gas stream of step (k) is selected to approximate the preferred flash pressure for the second stage of pressure reduction when employing expansion valves in all stages of pressure reduction and the pressure of step (i) is selected such that the energy generated in this step is sufficient to compress the gas stream of step (i) to said flash pressure for the second pressure reduction stage.

46. A process according to claim 36 wherein the pressure of said compressed warmed gas stream of step (e) is selected to approximate the preferred flash pressure for the first stage of pressure reduction when employing expansion valves in all stages of pressure reduction and the pressure of step (b) is selected such that the energy generated in this step is sufficient to compress the gas stream of step (b) to said flash pressure for the first pressure reduction stage of interest and wherein the pressure of said compressed warmed second gas stream of step (k) is selected to approximate the preferred flash pressure for the second stage of pressure reduction when employing expansion valves in all stages of pressure reduction and the pressure of step (i) is selected such that the energy generated in this step is sufficient to compress the gas stream of step (i) to said flash pressure for the second pressure reduction stage.

47. A process according to claim 38 wherein the pressure of said compressed warmed gas stream of step (e) is selected to approximate the preferred flash pressure for the first stage of pressure reduction when employing expansion valves in all stages of pressure reduction and the pressure of step (b) is selected such that the energy generated in this step is sufficient to compress the gas stream of step (b) to said flash pressure for the first pressure reduction stage of interest and wherein the pressure of said compressed warmed second gas stream of step (k) is selected to approximate the preferred flash pressure for the second stage of pressure reduction when employing expansion valves in all stages of pressure reduction and the pressure of step (h) is selected such that the energy generated in this step is sufficient to compress the gas stream of step (i) to said flash pressure for the second pressure reduction stage.

48. A process according to claim 47 wherein said energy is mechanical.

49. An apparatus comprising (a) a first indirect heat exchange means;

(b) a first directional flow control means;

(c) a first junction means;

(d) a liquid expander;

(e) an expansion valve;

(f) a gas liquid separator;

(g) a second indirect heat exchange means situated in close proximity to the first indirect heat exchange means and situated such that fluids flowing though such means flow generally countercurrent to one another;

(h) a single-stage compressor;

(i) a mechanical or hydraulic coupling between the liquid expander of (d) and the compressor of (h);

(j) a second directional flow control means;

(k) a second junction means;

(l) a multi-stage compressor;

(m) a conduit connected to the inlet of the first indirect heat exchange means;

(n) a conduit connected to the outlet of the first indirect heat exchange means and the inlet to the first directional flow control means;

(o) a conduit connected to an outlet of the first directional flow control means and to the liquid expander;

(p) a conduit connected to the liquid expander and to the first junction means;

(q) a conduit connected to an outlet of the first direction flow control means and to the expansion valve;

(r) a conduit connected to the expansion valve and the first junction means;

(s) a conduit connected to the first junction means and the gas-liquid separator;

(t) a conduit connected to the upper section of the gas-liquid separator and the inlet to the second indirect heat exchange means;

(u) a conduit connected to the outlet to the second indirect heat exchange means and the inlet to the second directional flow control means;

(v) a conduit connected to the outlet of the second directional flow control means and the single-stage compressor;

(w) a conduit connected to the single-stage compressor and the second junction means;

(x) a conduit connected to an outlet of the second directional flow control means and the second junction means; and (y) a conduit between the second junction means and the high-stage inlet port of the multi-stage compressor.

50. The apparatus according to claim 49 wherein the expander of (d) is mechanically coupled to the compressor of (h).

51. The apparatus according to claim 49 wherein said multi-stage compressor has three stages.

52. The apparatus according to claim 50 wherein said multi-stage compressor has three stages.

53. The apparatus according to claim 49 additionally comprising (z) a third indirect heat exchange means;

(aa) a third directional flow control means;

(bb) a third junction means;

(cc) a second liquid expander;

(dd) a second expansion valve;

(ee) a second gas-liquid separator;

(ff) a fourth indirect heat exchange means situated in close proximity to the third indirect heat exchange means and situated such that fluids flowing though such means flow generally countercurrent to one another;

(gg) a second single-stage compressor;

(hh) a second mechanical or hydraulic coupling between the second liquid expander and the second compressor;

(ii) a fourth directional flow control means;

(jj) a fourth junction means;

(kk) a conduit connected to the lower section of the gas-liquid separator and the third indirect heat exchange means;

(ll) a conduit connected to the outlet of the third indirect heat exchange means and the inlet to the third directional flow control means;

(mm) a conduit connected to an outlet of the third directional flow control means and to the second liquid expander;

(nn) a conduit connected to the second liquid expander and to the third junction means;

(oo) a conduit connected to an outlet of the third direction flow control means and to the second expansion value;

(pp) a conduit connected to the second expansion valve and the third junction means;

(qq) a conduit connected to the third junction means and the second gas-liquid separator;

(rr) a conduit connected to the upper section of the second gas-liquid separator and the inlet to the fourth indirect heat exchange means;

(ss) a conduit connected to the outlet to the fourth indirect heat exchange means and the inlet to the fourth directional flow control means;

(tt) a conduit connected to the outlet of the fourth directional flow control means and the second compressor;

(uu) a conduit connected to the second compressor and the fourth junction means;

(vv) a conduit connected to an outlet of the fourth directional flow control means and the fourth junction means; and (ww) a conduit between the fourth junction means and either the intermediate-stage or low-stage inlet port at the multistage compressor.

54. The apparatus according to claim 53 wherein the second expander is mechanically coupled to the second single-stage compressor of (h).

55. The apparatus according to claim 53 wherein said multi-stage compressor has three stages and said conduit of (ww) is connected to the intermediate-stage inlet port.

56. The apparatus according to claim 54 wherein said multi-stage compressor has three stages and said conduit of (ww) is connected to the intermediate-stage inlet port.

* * * * *